US009583844B2

(12) United States Patent
Nespoulous et al.

(10) Patent No.: US 9,583,844 B2
(45) Date of Patent: Feb. 28, 2017

(54) FEMALE CONTACT COMPRISING A SPRING

(71) Applicant: SOCIETE TECHNIQUE DE PRODUCTIONS INDUSTRIELLES, Paris (FR)

(72) Inventors: Michel Nespoulous, Hauppauge, NY (US); Christophe Boucher, Paris (FR); Pascal Cuirot, Paris (FR)

(73) Assignee: SOCIETE TECHNIQUE DE PRODUCTIONS INDUSTRIELLES, Paris (FR)

( * ) Notice: Subject to any disclaimer, the term of this patent is extended or adjusted under 35 U.S.C. 154(b) by 0 days.

(21) Appl. No.: 15/065,918

(22) Filed: Mar. 10, 2016

(65) Prior Publication Data

US 2016/0268707 A1 Sep. 15, 2016

(30) Foreign Application Priority Data

Mar. 13, 2015 (FR) ..... 15 52068

(51) Int. Cl.

| | |
|---|---|
| ***H01R 4/48*** | (2006.01) |
| ***H01R 13/187*** | (2006.01) |
| ***H01R 13/03*** | (2006.01) |
| ***H01R 43/20*** | (2006.01) |
| *H01R 107/00* | (2006.01) |

(52) U.S. Cl.

CPC ..... *H01R 4/48* (2013.01); *H01R 13/03* (2013.01); *H01R 13/187* (2013.01); *H01R 43/20* (2013.01); *H01R 2107/00* (2013.01)

(58) Field of Classification Search

CPC ..... H01R 4/48; H01R 4/38; H01R 13/03; H01R 13/187; H01R 43/20; H01R 13/2421

USPC ..... 439/841, 851, 843, 820, 700

See application file for complete search history.

(56) References Cited

U.S. PATENT DOCUMENTS

| | | | | |
|---|---|---|---|---|
| 4,105,280 | A * | 8/1978 | Thompson, Jr. ..... | H01H 1/385 439/700 |
| 4,632,496 | A | 12/1986 | Williams | |
| 4,655,526 | A * | 4/1987 | Shaffer ..... | H01R 13/193 439/159 |
| 4,775,335 | A * | 10/1988 | Havel ..... | H01R 13/193 439/820 |
| 4,906,210 | A | 3/1990 | McNiel | |

(Continued)

FOREIGN PATENT DOCUMENTS

FR 2 596 587 A1 10/1987

OTHER PUBLICATIONS

French Search Report, dated Nov. 5, 2015, from corresponding French application.

*Primary Examiner* — Abdullah Riyami
*Assistant Examiner* — Harshad Patel
(74) *Attorney, Agent, or Firm* — Young & Thompson

(57) ABSTRACT

A female contact intended to receive a male contact, the female contact including a base and at least one side wall having a free edge defining an open end, the side wall being connected to the base and including an inner wall, wherein: the female contact includes a helical spring made of an electrically conductive material disposed between the base and the open end; part of the inner wall and the base are made of an electrically conductive material; and the inner wall of the female contact and/or the spring assure/assures electrical contact with a male contact in the position of use.

10 Claims, 6 Drawing Sheets

(56) References Cited

U.S. PATENT DOCUMENTS

| | | | | |
|---|---|---|---|---|
| 4,906,211 | A | 3/1990 | Bell et al. | |
| 6,239,393 | B1 * | 5/2001 | Hansen | F16F 1/08 200/276 |
| 7,666,000 | B1 * | 2/2010 | Hsiao | G01R 1/0466 439/66 |
| 7,682,206 | B2 * | 3/2010 | Kainz | H01R 13/187 439/700 |
| 8,995,141 | B1 * | 3/2015 | Rathi | H05K 3/32 248/229.22 |

* cited by examiner

FEMALE CONTACT COMPRISING A SPRING

FIELD OF THE INVENTION

The present invention relates to a female contact intended to receive a male contact. More particularly, the invention relates to a female contact comprising a spring intended to establish electrical contact between said female contact and a male contact.

The present invention also relates to a method for modifying an existing female connector.

BACKGROUND OF THE INVENTION

A female connector is a device comprising at least one female contact in which a male connector comprising at least one male contact is inserted in order to establish electrical contact. The electrical contact is established when the female contact is in contact with the male contact.

It is therefore essential that the contact between the female contact and the male contact does not have any faults, so that electrical contact can be established continuously.

This type of connection exists in a very large number of electrical devices including, for example, electrical relays and baseplates thereof.

Electrical relays and baseplates thereof are thus formed of a female connector (referred to as a baseplate) comprising at least one female contact (referred to as a socket) into which a male connector (referred to as a relay) comprising at least one male contact is inserted.

FIG. 1 illustrates the points of electrical contact between a female contact and a male contact in a conventional connection. This electrical contact is produced at the inner wall of the side wall of the female contact.

However, when these connections are used in harsh conditions, that is to say for example subjected to strong vibrations, or when they are subjected to numerous manipulations resulting in many inserts/removals of the female contact with the male contact, the female contact deforms and the electrical contact is then no longer assured continuously.

In addition, the female contacts integrated in electrical connections must have very precise measurements since their dimensioning is dependent in particular on the measurements of the corresponding male contact. However, very slight dimensioning variations may appear during the manufacture of the female contacts. This is why it is very important for the contact between the female contact and a male contact to be established continuously even if the female contacts do not have exactly the required measurements.

Consequently, it would be beneficial to provide a female contact making it possible to assure continuous electrical contact whatever the conditions of use (environment, duration, etc.) and even when slight dimensioning variations occur during the manufacturing process thereof or during use thereof.

The inventors have shown that a female contact comprising a spring would be able to satisfy these requirements.

SUMMARY OF THE INVENTION

The invention therefore firstly relates to a female contact intended to receive a male contact, said female contact comprising a base and at least one side wall having a free edge defining an open end, said side wall being connected to the base and comprising an inner wall, wherein:

- the female contact comprises a helical spring made of an electrically conductive material disposed between the base and the open end,
- part of the inner wall and the base are made of an electrically conductive material, and
- the inner wall of the female contact and/or the spring assure/assures electrical contact with a male contact in the position of use, and
- said helical spring comprises a lower part having a diameter $d_{PI}$ and an upper part having a diameter $d_{PS}$ with $d_{PI}>d_{PS}$, the lower part of the helical spring being oriented from the side of the base of the female contact and the upper part of the helical spring being oriented toward the free edge of the female contact.

In the context of the invention, the term "female contact" means any device making it possible to establish electrical contact when a male contact is inserted therein.

Hereinafter, the terms "female contact" and "socket" will be used synonymously.

In accordance with an embodiment, the female contact is a contact used in a connector such as a baseplate for an electrical relay. The female contact may be provided in the form of a socket having two lips or four lips.

In accordance with a particular embodiment of the invention, not only the inner wall of the side wall of the female contact but also the spring assure electrical contact with a male contact in the position of use, in order to maximize the points of contact between the female contact and a male contact.

In accordance with an embodiment of the invention the spring is in contact with the base of the female contact.

In accordance with an embodiment the base of the female contact is provided in the form of a conical cavity.

In accordance with another embodiment of the invention the base of the female contact is flat and is selected from the group consisting of a circular, oval, rectangular or square base.

In accordance with the invention the female contact comprises at least one side wall. The number of side walls will depend in particular on the shape of the base.

Examples include a female contact comprising a circular base and one side wall or a female contact comprising a square base and four side walls.

In accordance with the invention the coordinate system (X, Y, Z) is used in which the direction X is the longitudinal direction of the side wall.

In accordance with an embodiment the side wall has at least one interruption (also referred to as a slot) along the direction X.

In accordance with a particular embodiment the side wall has two diametrically opposed slots which extend substantially from the base to the open end of the female contact, thus creating two lips that can deform under mechanical load. In effect, in this embodiment, the two lips make it possible to pinch closed the open end of the female contact prior to the insertion of the male contact. When the male contact is inserted into the female contact in order to be brought into its position of use, the lips deform slightly, but maintain the pinching of the open end so as to promote the contact with the male contact in the female contact in the position of use.

Thus, in accordance with a particular embodiment, the female contact has resilient properties so as to be able to deform.

In addition, in accordance with the invention, at least part of the inner wall, the base and the spring are made of an electrically conductive material so as to be able to establish electrical contact between the female contact and a male contact.

This is why, in a particular embodiment, the female contact is produced using a material that is both resilient and electrically conductive, selected from the group consisting of copper alloys, such as beryllium copper, copper-nickel, brass, and mixtures thereof.

The spring of the invention may be provided in different forms, provided it deforms under the action of an external force thus making it possible to adapt to male contacts of different length.

In accordance with an embodiment the helical spring is provided in the form of a sequence of non-contiguous turns with a constant pitch, i.e. with a constant distance between two successive turns.

In accordance with an embodiment the helical spring has a pitch between 0.1 mm and 2 mm, preferably between 0.4 mm and 0.8 mm.

In accordance with an embodiment the helical spring has turns having a constant diameter $d_{spires}$ between 0.2 mm and 1 mm, preferably between 0.3 mm and 0.5 mm.

In accordance with the invention the helical spring has a lower part having a diameter $d_{PI}$ and an upper part having a diameter $d_{PS}$ with $d_{PI}>d_{PS}$, the lower part of the helical spring being oriented on the side of the base of the female contact and the upper part of the helical spring being oriented toward the free edge of the female contact.

In accordance with another embodiment the female contact is tubular and has a base of inner diameter $d_b$ and the ratio between the diameter $d_{PI}$ of the spring and the inner diameter $d_b$ of the base ($d_{PI}/d_b$) is substantially greater than 1.

The term "substantially greater than 1" means a maximum variation of 10% around the value 1.

Thus, in accordance with this embodiment, the spring is fixed integrally to the female contact, irrespective of the conditions of use.

The dimensions given, above, which are non-limiting, are given on the basis of a reference male contact having a length of 15.7 mm.

In accordance with an embodiment $d_{PI}$ is between 1 and 3 mm, preferably between 1.4 and 1.7 mm.

In accordance with an embodiment $d_{PS}$ is between 0.5 and 2.5 mm, preferably between 1.2 and 1.4 mm.

In accordance with an embodiment $d_b$ is between 1 mm and 3.5 mm, preferably between 1.4 and 1.9 mm.

A person skilled in the art will know to find a suitable ratio between the length of the spring $l_r$ and the length of the female contact $l_{CF}$ on the basis of the dimensions of the male contact having to be inserted into the female contact.

In accordance with the invention the spring is made of a material having the two following combined features: from a mechanical viewpoint the spring must be resilient, and from an electrical viewpoint the spring must be conductive.

Thus, in accordance with an embodiment, the spring is made of a material selected from the group consisting of copper alloys, such as beryllium copper, copper-nickel, brass, and mixtures thereof.

In accordance with an embodiment the spring and the female contact are produced using the same material(s).

In order to improve the mechanical and electrical properties thereof, the material of the spring may be subjected to different treatments, such as heat treatments and/or surface treatments (for example gold deposition on the entire surface of the spring).

A person skilled in the art will know to choose suitable materials on the basis of the amperage that must pass through the female contact. By way of example, for a spring made of beryllium copper having a diameter $d_{spires}$ of 0.4 mm, the amperage is approximately 5 amperes (5 A).

In accordance with the invention the female contact can be found in different connectors, such as baseplates for electrical relays or any conventional connections comprising connectors.

Thus, the invention also relates to a connector comprising at least one female contact as defined in accordance with the invention.

In accordance with an embodiment the female connector comprises between 12 and 24 female contacts.

The invention also relates to a kit comprising a connector comprising at least one female contact as defined in accordance with the invention and one male connector.

The invention also relates to a kit comprising a connector comprising at least one female contact, at least one spring as defined above, and one male connector.

The presence of the spring in the female contact of the invention makes it possible to establish reliable contact, irrespective of the conditions of use.

Thus, the invention also relates to the use of the female contact, of the female connector, or of the kits as defined in the present invention under conditions generating strong mechanical and/or thermal stresses, as might be encountered in transport means, such as aircraft or trains, etc.

The present invention also relates to a method for modifying a female connector intended to receive a male connector comprising the following steps:

(i) providing a female connector comprising at least one female contact intended to receive a male connector comprising at least one male contact, said female contact comprising a base and at least one side wall having a free edge defining an open end, the side wall comprising an inner wall and being connected to the base;

(ii) inserting a helical spring made of an electrically conductive material between the base and the open end of the female contact;

(iii) possibly inserting a male contact into the female contact modified in step (ii) so as to establish electrical contact via the inner wall of the female contact and/or via the spring, characterized in that said helical spring comprises a lower part having a diameter $d_{PI}$ and an upper part having a diameter $d_{PS}$ with $d_{PI}>d_{PS}$, the lower part of the helical spring being oriented from the side of the base of the female contact and the upper part of the helical spring being oriented toward the free edge of the female contact.

Thus, the method of the invention makes it possible to use female contacts that do not have exactly the precise dimensions required in order to establish electrical contact with a male contact and/or makes it possible to increase the service life of a female contact which would have been deformed over time. In effect, the presence of the spring makes it possible to establish the electrical contact between the female contact and a male contact even if the male contact is not in direct contact with the side wall of the female contact.

The method of the invention also makes it possible to re-establish electrical contact in a faulty connector very quickly and very conveniently whilst avoiding removal of the electrical cables of the electrical device as a whole in which the female contact is integrated.

In accordance with an embodiment the spring is inserted into the female contact until the spring is in contact with the base of the female contact.

In accordance with another embodiment the spring is inserted by force into the female contact in order to assure that said spring is held in the female contact whatever the conditions of use.

In accordance with an embodiment the base of the female contact is provided in the form of a conical cavity.

In accordance with an embodiment of the invention the base of the female contact is flat and is selected from the group consisting of a circular, oval, rectangular, or square base.

In accordance with the invention the female contact comprises at least one side wall. The number of side walls will depend in particular on the shape of the base.

Examples include a female contact comprising a circular base and a side wall or a female contact comprising a square base and four side walls.

In accordance with the invention the coordinate system (X, Y, Z) is used in which the direction X is the longitudinal direction of the side wall.

In accordance with an embodiment the side wall has at least one interruption (also referred to as a slot) along the direction X.

In accordance with a particular embodiment the side wall has two diametrically opposed slots, which extend substantially from the base to the open end of the female contact, thus creating two lips that can deform under mechanical load. In effect, in this embodiment, the two lips make it possible to pinch closed the open end of the female contact prior to the insertion of the male contact. When the male contact is inserted into the female contact in order to be brought into its position of use, the lips deform slightly, but maintain the pinching of the open end so as to promote the contact with the male contact in the female contact in the position of use.

Thus, in accordance with a particular embodiment, the female contact has resilient properties so as to be able to deform.

In addition, in accordance with the invention, at least part of the inner wall, the base and the spring are made of an electrically conductive material so as to be able to establish electrical contact between the female contact and a male contact.

This is why, in a particular embodiment, the female contact is produced using a material that is both resilient and electrically conductive, selected from the group consisting of copper alloys, such as beryllium copper, copper-nickel, brass, and mixtures thereof.

The spring of the invention may be provided in different forms, provided it deforms under the action of an external force thus making it possible to adapt to male contacts of different length.

In accordance with an embodiment combined with the previous embodiment the helical spring is provided in the form of a sequence of non-contiguous turns with a constant pitch, i.e. with a constant distance between two successive turns.

In accordance with an embodiment the helical spring has a pitch between 0.1 mm and 2 mm, preferably between 0.4 mm and 0.8 mm.

In accordance with an embodiment the helical spring has turns having a constant diameter $d_{spires}$ between 0.2 mm and 1 mm, preferably between 0.3 mm and 0.5 mm.

In accordance with the invention the helical spring has a lower part having a diameter $d_{PI}$ and an upper part having a diameter $d_{PS}$ with $d_{PI}>d_{PS}$, the lower part of the helical spring being oriented from the side of the base of the female contact and the upper part of the helical spring being oriented toward the free edge of the female contact.

In accordance with another embodiment the female contact is tubular and has a base of inner diameter $d_b$ and the ratio between the diameter $d_{PI}$ of the spring and the inner diameter $d_b$ of the base ($d_{PI}/d_b$) is substantially greater than 1.

The term "substantially greater than 1" means a maximum variation of 10% around the value 1.

Thus, in accordance with this embodiment, the spring is fixed integrally to the female contact, irrespective of the conditions of use.

The dimensions given, above, which are non-limiting, are given on the basis of a reference male contact having a length of 15.7 mm.

In accordance with an embodiment $d_{PI}$ is between 1 and 3 mm, preferably between 1.4 and 1.7 mm.

In accordance with an embodiment $d_{PS}$ is between 0.5 and 2.5 mm, preferably between 1.2 and 1.4 mm.

In accordance with an embodiment $d_b$ is between 1 mm and 3.5 mm, preferably between 1.4 and 1.9 mm.

A person skilled in the art will know to find a suitable ratio between the length of the spring $l_r$ and the length of the female contact $l_{CF}$ on the basis of the dimensions of the male contact having to be inserted into the female contact.

In accordance with the invention the spring is made of a material having the two following combined features: from a mechanical viewpoint the spring must be resilient, and from an electrical viewpoint the spring must be conductive.

Thus, in accordance with an embodiment the spring is made of a material selected from the group consisting of copper alloys, such as beryllium copper, copper-nickel, brass, and mixtures thereof.

The spring and the female contact are advantageously produced using the same material(s).

In order to improve the mechanical and electrical properties thereof, the material of the spring may be subjected to different treatments, such as heat treatments or surface treatments (for example gold deposition on the entire surface of the spring).

A person skilled in the art will know to choose suitable materials on the basis of the amperage that must pass through the female contact. By way of example, for a spring made of beryllium copper having a diameter $d_{spires}$ of 0.4 mm, the amperage is approximately 5 amperes (5 A).

BRIEF DESCRIPTION OF THE DRAWINGS

The invention will be described in greater detail hereinafter with the aid of the accompanying drawings, in which.

DETAILED DESCRIPTION OF THE INVENTION

Figure 1:
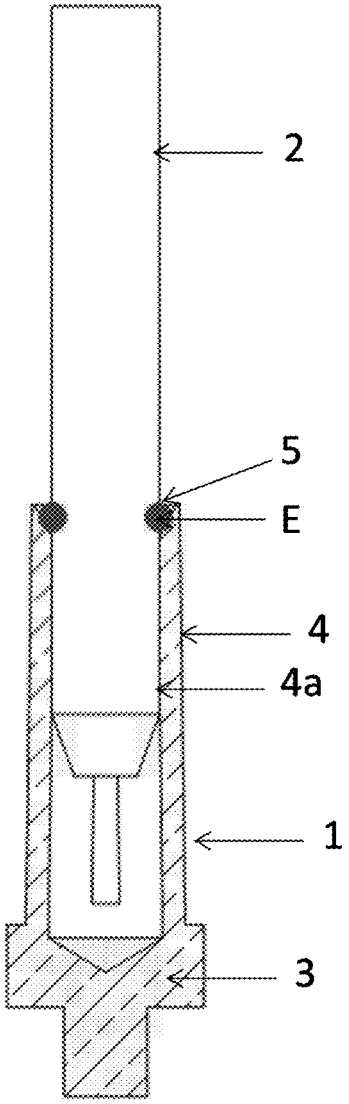
FIG. 1 shows partially in section a male contact inserted into a baseplate socket for an electrical relay of the prior art.

FIG. 1 illustrates the points of electrical contact between a female contact 1 (here a socket) and a male contact 2 in a baseplate for a conventional electrical relay.

The female contact 1 comprises a base 3, at least one side wall 4 being connected to the base 3 and comprising an inner wall 4*a*. The side wall 4 has a free edge defining an open end 5, into which the male contact 2 will be inserted in the position of use.

The electrical contact E (shown by round contact points in FIG. 1) is established by contact between the inner surface 4*a* of the side wall 4 of the female contact 1 and the male contact 2 in an upper part of the female contact (that is to say close to the open end 5).

Figure 2:
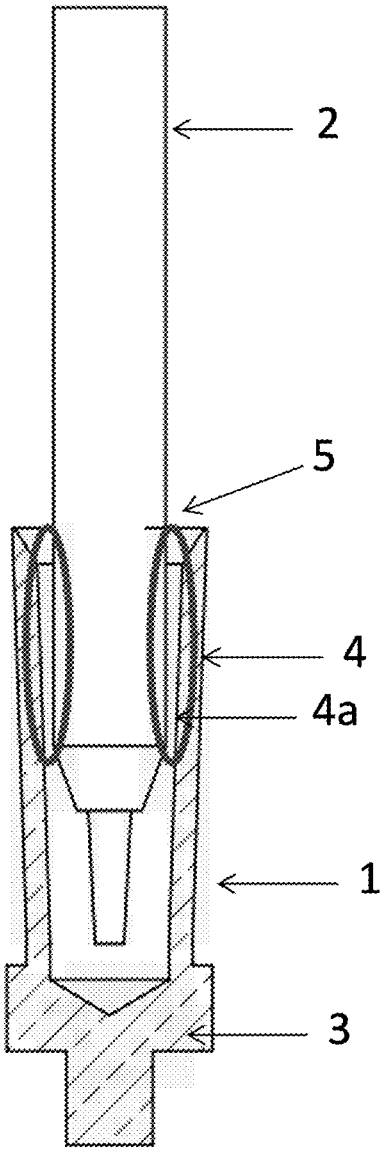
FIG. 2 shows the assembly of the male contact inserted into the socket of the baseplate for the electrical relay of FIG. 1 having undergone deformations following use in harsh conditions.

However, as explained beforehand and as illustrated in an exaggerated manner with FIG. 2, when the baseplates for relays are used in harsh conditions, or when they are subjected to numerous manipulations, the upper part of the female contact 1 deforms and the electrical contact is no longer assured continuously.

Figure 3:
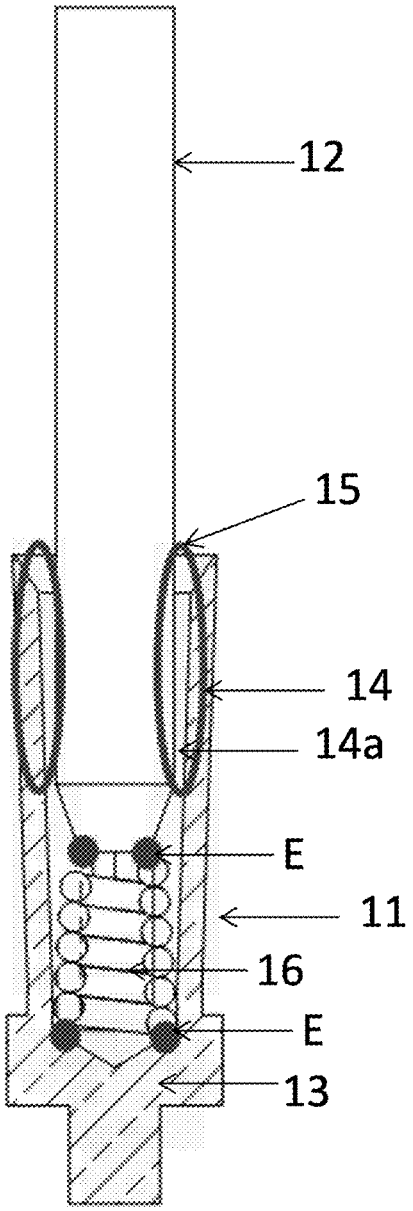
FIG. 3 shows a longitudinal section of a male contact inserted into a baseplate socket for an electrical relay according to the present invention.

By contrast with female contacts of the prior art, the female contact 11 of the present invention illustrated in FIG. 3 comprises a spring 16 disposed on the base 13 of said female contact. Thus, even if the electrical contact can no longer be established by contact between the inner surface 14*a* of the side wall 14 and the male contact 12, it is assured by the presence of the spring 16. In effect, as illustrated in FIG. 3, the points of contact E are located both between the male contact 12 and the spring 16 and between the spring 16 and the base 13 of the female contact 11.

The structure of the female contact is described below in further detail by way of FIGS. 4*a* to 4*c*.

Figure 4A:
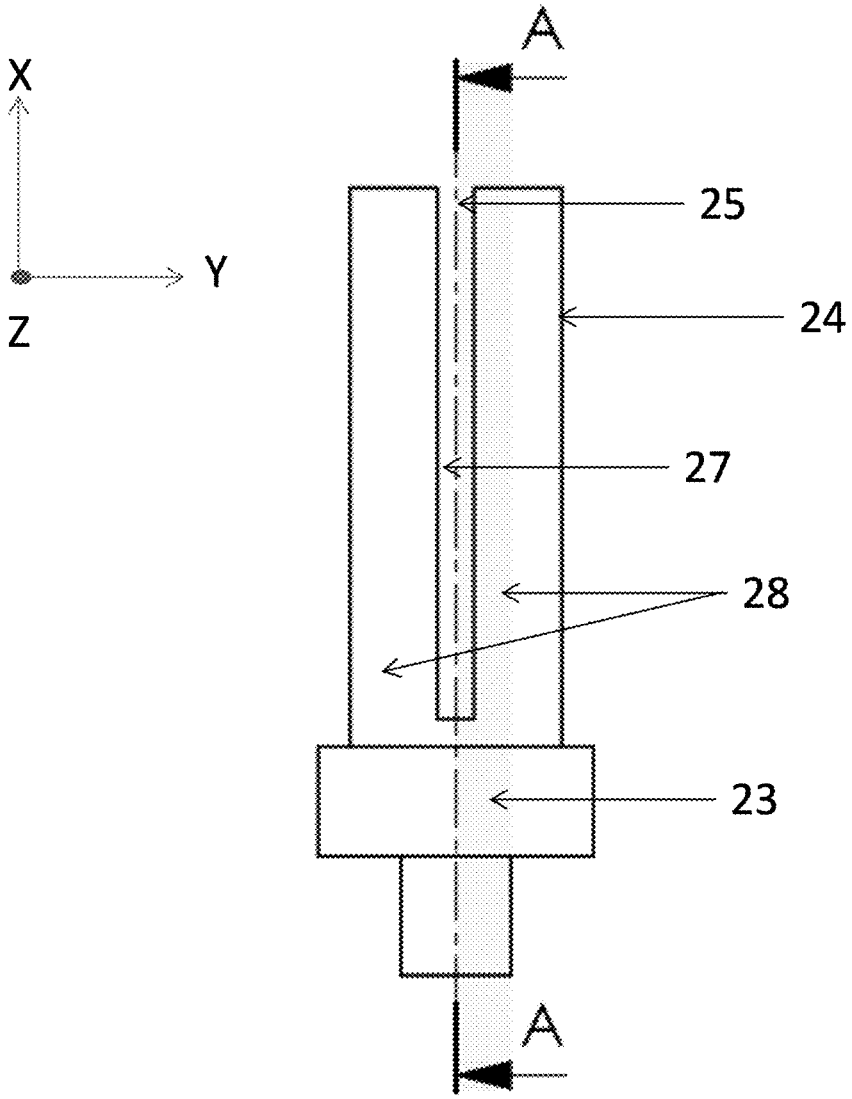
FIGS. 4*a*-4*d* schematically show a socket in accordance with an embodiment of the invention.

FIG. 4*a* shows a side view of the female contact according to the invention. The female contact 21 comprises a circular base 23 (shown in FIG. 4*b*) and a side wall 24 connected to the base 23. The side wall comprises an inner wall 24*a* and a free edge defining an open end 25. The side wall 24 comprises two diametrically opposed slots 27 extending substantially from the base 23 to the open end 25 of the female contact 21 along the axis X, thus creating two lips 28.

Figure 4B:
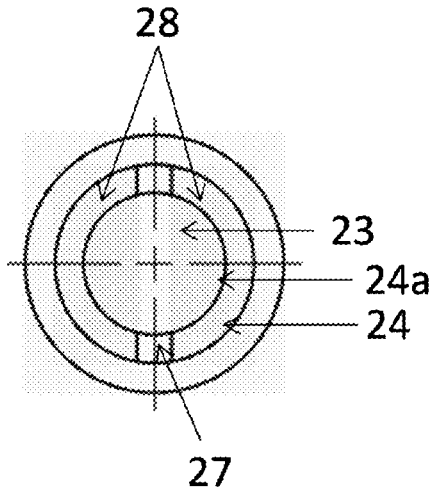

FIG. 4*b* is a view from above of FIG. 4*a* showing that the female contact is provided in a tubular form and comprises a circular base 23 connected to a side wall 24 comprising two diametrically opposed slots 27.

Figure 4C:
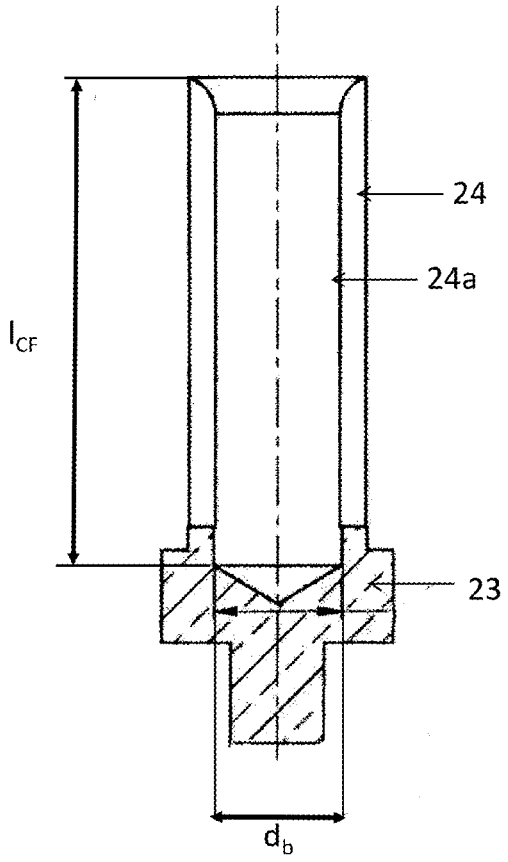

FIG. 4*c* is a section along the axis A-A of FIG. 4*a*. In accordance with a particular embodiment the base 23 of the female contact 21 has an inner diameter $d_b$ substantially smaller than the diameter of the lower part $d_{PI}$ of the spring intended to be in contact with the base (not shown in FIG. 4*c*). The length $l_{CF}$ of the female contact 21 will depend on the length of the male contact having to be inserted into the female contact. In accordance with an embodiment the length $l_{CF}$ of the female contact 21 is between 3 and 10 mm, preferably between 5 and 8 mm.

In accordance with an embodiment the diameter $d_b$ is between 1 and 3.5 mm, preferably between 1.4 and 1.9 mm.

Figure 4D:
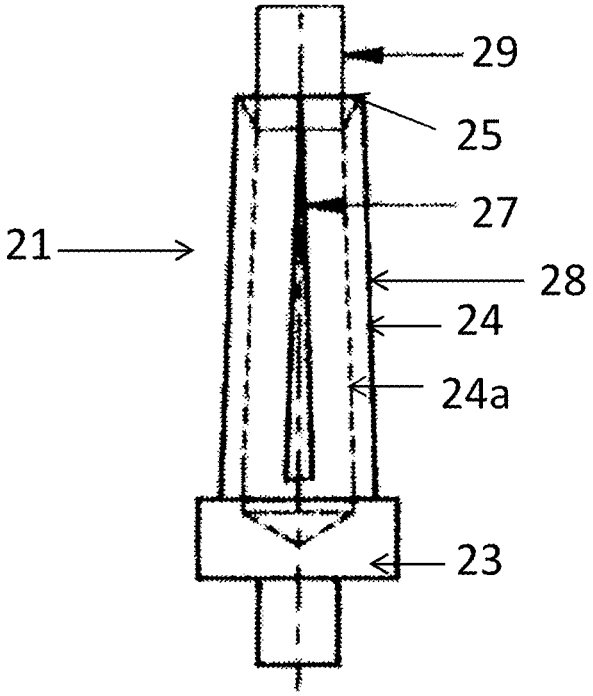

FIG. 4*d* shows a side view of the female contact of FIGS. 4*a* and 4*b* after pinching of the two lips 28. As illustrated in FIG. 4*d*, the width of the slot 27 is no longer constant as in FIG. 4*a*, but reduces from the base 23 to the open end 25 until becoming practically zero.

Thus, when the male contact 29 (shown only in part in FIG. 4*d*) is inserted into the female contact 21, the lips 28 deform slightly, but maintain a pinching of the open end 25 so as to promote the contact with the male contact 29 in the female contact 21 in the position of use.

Figure 5:
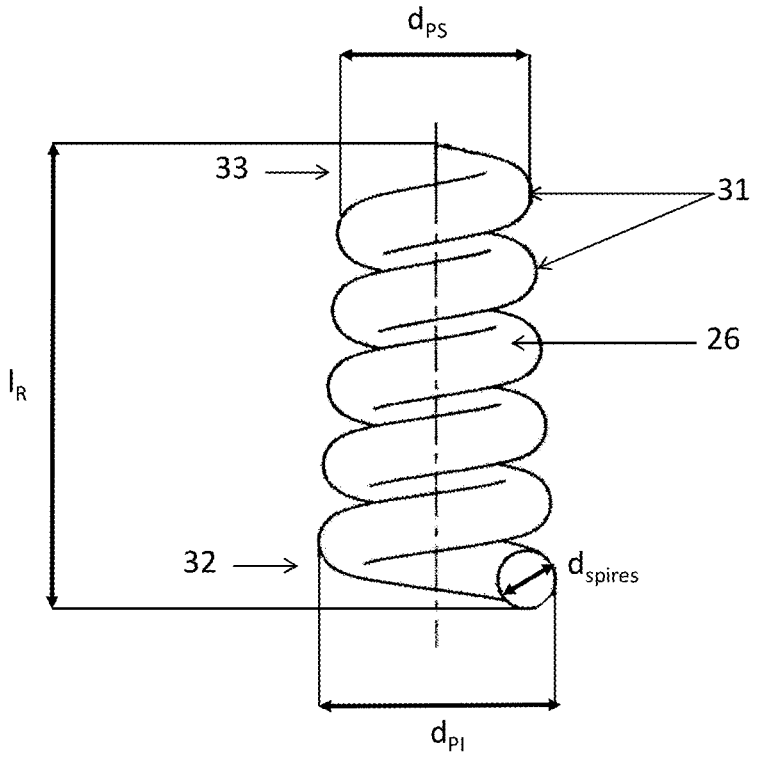
FIG. 5 schematically shows a spring comprised in a socket in accordance with an embodiment of the invention.

FIG. 5 shows a helical spring 26 in accordance with an embodiment of the invention. The helical spring 26 comprises a sequence of five non-contiguous turns 31 having a constant pitch.

The turns 31 have a constant diameter $d_{spires}$ between 0.2 mm and 1 mm, preferably between 0.3 mm and 0.5 mm.

The helical spring 26 comprises a lower part 32 having a diameter $d_{PI}$ and an upper part 33 having a diameter $d_{PS}$ with $d_{PI}>d_{PS}$, the lower part 32 of the helical spring 25 being oriented from the side of the base 23 of the female contact and the upper part 33 of the helical spring 26 being oriented toward the open end 25 of the female contact.

Thus, the female contact of the present invention is quite suitable for integration in baseplates for electrical relays of small size requiring female contacts having very precise measurements.

In addition, the method of the invention makes it possible to establish electrical contact in connectors comprising contacts which do not have exactly the required measurements.

Lastly, the method of the invention makes it possible to extend the service life of electrical installations in which faulty connectors are integrated, by re-establishing the electrical contact and avoiding removal of all the cables of said electrical installations.

The invention claimed is:

1. A female contact (11, 21) intended to receive a male contact (12, 29), said female contact (11, 21) comprising a base (13, 23) and at least one side wall (14, 24) having a free edge defining an open end (15, 25), said side wall (14, 24) being connected to the base (13, 23) and comprising an inner wall (14*a*, 24*a*), wherein:

the female contact (11, 21) comprises a helical spring (16, 26) made of an electrically conductive material disposed between the base (13, 23) and the open end (15,25), part of the inner wall (14*a*, 24*a*) and the base (13, 23) are made of an electrically conductive material, and the inner wall (14*a*, 24*a*) of the female contact (11, 21) and/or the spring (16, 26) assure/assures electrical contact with a male contact (12, 29) in the position of use, wherein said helical spring (16, 26) comprises a lower part (32) having a diameter $d_{PI}$ and an upper part (33) having a diameter $d_{PS}$ with $d_{PI}>d_{PS}$, the lower part (32) of the helical spring being oriented from the side of the base (13, 23) of the female contact and the upper part (33) of the helical spring being oriented toward the free edge of the female contact.

2. The female contact (11, 21) as claimed in claim 1, wherein the spring (16, 26) is in contact with the base (13, 23) of the female contact.

3. The female contact (11, 21) as claimed in claim 1, wherein:

the female contact is tubular and has a base of inner diameter $d_b$; and the ratio between the diameter $d_{PI}$ and the inner diameter $d_b$ is substantially greater than 1.

4. The female contact (11, 21) as claimed in claim 1, wherein the spring (16, 26) is made of a material selected from the group consisting of copper alloys.

5. The female contact (11, 21) as claimed in claim 1, wherein the side wall has two diametrically opposed slots extending substantially from the base to the open end of the female contact.

6. A female connector comprising at least one female contact (11, 21) as defined as claimed in claim 1.

7. A kit comprising the female connector as defined in claim 6 and a male connector.

8. A method for modifying a female connector intended to receive a male connector, comprising the following steps:

(i) providing a female connector comprising at least one female contact (11, 21) intended to receive a male connector comprising at least one male contact (12, 29), said female contact (11, 21) comprising a base (13, 23) and at least one side wall (14, 24) having a free edge defining an open end (15, 25), said side wall (14, 24) being connected to the base (13, 23) and comprising an inner wall (14*a*, 24*a*);

(ii) inserting a helical spring (16, 26) made of an electrically conductive material between the base (13, 23) and the open end (15, 25) of the female contact;

(iii) optionally inserting a male contact into the female contact modified in step (ii) so as to establish electrical contact via the inner wall (14*a*, 24*a*) of the female contact and/or via the spring;

wherein said helical spring (16, 26) comprises a lower part (32) having a diameter $d_{PI}$ and an upper part (33) having a diameter $d_{PS}$ with $d_{PI}>d_{PS}$, the lower part (32) of the helical spring being oriented from the side of the base (13, 23) of the female contact and the upper part (33) of the helical spring being oriented toward the free edge of the female contact.

9. The method as claimed in claim 8, wherein the spring is inserted until the spring (16, 26) is in contact with the base (13, 23) of the female contact.

10. The female contact (11, 21) as claimed in claim 4, wherein copper alloys are beryllium copper, copper-nickel, brass, and mixtures thereof.

* * * * *